US008451171B1

(12) United States Patent
Santoru

(10) Patent No.: US 8,451,171 B1
(45) Date of Patent: May 28, 2013

(54) TOOL TO AUTOMATICALLY ALIGN OUTDOOR UNIT

(75) Inventor: Joseph Santoru, Agoura Hills, CA (US)

(73) Assignee: The DIRECTV Group, Inc., El Segundo, CA (US)

( * ) Notice: Subject to any disclaimer, the term of this patent is extended or adjusted under 35 U.S.C. 154(b) by 1300 days.

(21) Appl. No.: 12/186,435

(22) Filed: Aug. 5, 2008

(51) Int. Cl.
*H01Q 1/12* (2006.01)

(52) U.S. Cl.
USPC ..... 342/359

(58) Field of Classification Search
USPC ..... 342/359
IPC ..... H01Q 1/1257,1/125, 1/1264
See application file for complete search history.

(56) References Cited

U.S. PATENT DOCUMENTS

| | | | | |
|---|---|---|---|---|
| 4,617,572 | A * | 10/1986 | Hugo | 343/765 |
| 5,029,062 | A * | 7/1991 | Capel | 363/26 |
| 5,043,737 | A * | 8/1991 | Dell-Imagine | 342/359 |
| 5,296,862 | A * | 3/1994 | Rodeffer et al. | 342/359 |
| 6,473,035 | B2 | 10/2002 | Fang | |
| 6,507,325 | B2 | 1/2003 | Matz et al. | |
| 6,563,471 | B2 | 5/2003 | Spirtus | |
| 6,653,981 | B2 * | 11/2003 | Wang et al. | 343/757 |
| 7,162,200 | B2 * | 1/2007 | Tsay et al. | 342/174 |
| 7,636,067 | B2 | 12/2009 | Norin | |
| 2002/0057225 | A1 * | 5/2002 | Spirtus | 343/757 |
| 2005/0135815 | A1 | 6/2005 | Gerwe et al. | |
| 2007/0072545 | A1 | 3/2007 | Karabinis et al. | |

OTHER PUBLICATIONS

DIRECTV Multi-Satellite Dish Antenna Installation Manual, DIRECTV Inc., 2003.*

Non-final Office action dated Jan. 18, 2011 in U.S. Appl. No. 12/269,811 filed Nov. 12, 2008 by Ernest C. Chen et al.

Nishiguchi, K.; Tsuchiya, K.: "Optimization of Coverage Pattern for Regional Communications Satellite"; Aerospace and Electronic Systems, IEEE Transactions on; vol. AES-18, No. 5; pp. 642-647; Sep. 1982.

Academic Press Dictionary of Science and Technology; 'signal-strength meter'; 1992; Elsevier Science & Amp; Technology; Oxford, United Kingdom; viewed Jan. 14, 2011; <It; from http:/www.credoreference.com/entry/apdst/signal_meter>.

Final Rejection dated Aug. 19, 2011 in U.S. Appl. No. 11/699,675 filed Jan. 30, 2007 by Adrian Yap et al.

Notice of Allowance dated Nov. 3, 2011 in U.S. Appl. No. 12/269,811 filed Nov. 12, 2008 by Ernest C. Chen et al.

Non-final Office action dated Feb. 4, 2011 in U.S. Appl. No. 12/269,807 filed Nov. 12, 2008 by Romulo Pontual et al.

* cited by examiner

*Primary Examiner* — Jack W Keith
*Assistant Examiner* — Fred H Mull

(57) ABSTRACT

An alignment tool for aligning an antenna to a satellite configuration and a method for aligning an antenna to a satellite configuration is disclosed. An alignment tool for aligning an antenna to a satellite configuration in accordance with the present invention comprises a meter for measuring a satellite downlink signal power from the antenna, a motor for adjusting at least one fine adjustment mechanism of the antenna, and a processor, coupled to the motor and to the meter, for commanding the motor based on the received power from the antenna, wherein the processor commands the motor to maximize a received power from the antenna.

14 Claims, 9 Drawing Sheets

TOOL TO AUTOMATICALLY ALIGN OUTDOOR UNIT

BACKGROUND OF THE INVENTION

1. Field of the Invention

The present invention relates generally to a satellite receiver system, and in particular, to an antenna assembly for such a satellite receiver system.

2. Description of the Related Art

Satellite broadcasting of communications signals has become commonplace. Satellite distribution of commercial signals for use in television programming currently utilizes multiple feedhorns on a single Outdoor Unit (ODU) which supply signals to up to eight Integrated Receiver Decoders (IRDs) on separate cables from a multiswitch.

FIG. 1 illustrates a typical satellite television installation of the related art.

System 100 is an embodiment that uses signals sent from Satellite A (SatA) 102, Satellite B (SatB) 104, and Satellite C (SatC) 106 (with transponders 28, 30, and 32 converted to transponders 8, 10, and 12, respectively), that are directly broadcast to an Outdoor Unit (ODU) 108 that is typically attached to the outside of a house 110. ODU 108 receives these signals and sends the received signals to IRD 112, which decodes the signals and separates the signals into viewer channels, which are then passed to television 114 for viewing by a user. There can be more than one satellite transmitting from each orbital location.

Satellite uplink signals 116 are transmitted by one or more uplink facilities 118 to the satellites 102-106 that are typically in geosynchronous orbit. Satellites 102-106 amplify and rebroadcast the uplink signals 116, through transponders located on the satellite, as downlink signals 120. Depending on the satellite 102-106 antenna pattern, the downlink signals 120 are directed towards geographic areas for reception by the ODU 108.

Each satellite 102-106 broadcasts downlink signals 120 in typically thirty-two (32) different sets of frequencies, often referred to as transponders, which are licensed to various users for broadcasting of programming, which can be audio, video, or data signals, or any combination. These signals have typically been located in the Ku-band Fixed Satellite Service (FSS) and Broadcast Satellite Service (BSS) bands of frequencies in the 10-13 GHz range. Future satellites will likely also broadcast in a portion of the Ka-band with frequencies of 18-21 GHz FIG. 2 illustrates a typical ODU of the related art.

ODU 108 typically uses reflector dish 122 and feedhorn assembly 124 to receive and direct downlink signals 120 onto feedhorn assembly 124. Reflector dish 122 and feedhorn assembly 124 are typically mounted on bracket 126 and typically attached to a structure for stable mounting. Feedhorn assembly 124 typically comprises one or more Low Noise Block converters 128, which are connected via wires or coaxial cables to a multiswitch, which can be located within feedhorn assembly 124, elsewhere on the ODU 108, or within house 110. LNBs typically downconvert the FSS and/or BSS-band, Ku-band, and Ka-band downlink signals 120 into frequencies that are easily transmitted by wire or cable, which are typically in the L-band of frequencies, which typically ranges from 950 MHz to 2150 MHz. This downconversion makes it possible to distribute the signals within a home using standard coaxial cables.

The multiswitch typically enables system 100 to selectively switch the signals from SatA 102, SatB 104, and SatC 106, and deliver these signals via cables to each of the IRDs 112A-D located within house 110. Typically, the multiswitch is a five-input, four-output (5×4) multiswitch, where two inputs to the multiswitch are from SatA 102, one input to the multiswitch is from SatB 104, and one input to the multiswitch is a combined input from SatB 104 and SatC 106. There can be other inputs for other purposes, e.g., off-air or other antenna inputs, without departing from the scope of the present invention. The multiswitch can be other sizes, such as a 6×8 multiswitch, if desired. SatB 104 typically delivers local programming to specified geographic areas, but can also deliver other programming as desired. The present invention will also work with an ODU 108 that uses a Single Wire Multiswitch (SWM), i.e., a multiswitch that has a single cable as an output which is coupled to multiple IRDs 112A-D.

To maximize the available bandwidth in the Ku-band of downlink signals 120, each broadcast frequency is further divided into polarizations. Each LNB 128 can receive both orthogonal polarizations at the same time with parallel sets of electronics, so with the use of either an integrated or external multiswitch, downlink signals 120 can be selectively filtered out from travelling through the system 100 to each IRD 112A-D.

IRDs 112A-D currently use a one-way communications system to control the multiswitch. Each IRD 112A-D typically has a dedicated cable 124 connected directly to the multiswitch, and each IRD independently places a voltage and signal combination on the dedicated cable to program the multiswitch, although other logic is used for a SWM configuration where a single cable connects the multiswitch to all of the IRDs 112A-D. For example, in one embodiment, IRD 112A may wish to view a signal that is provided by SatA 102. To receive that signal, IRD 112A sends a voltage/tone signal on the dedicated cable back to the multiswitch, and the multiswitch delivers the satA 102 signal to IRD 112A on dedicated cable 124. IRD 112B independently controls the output port that IRD 112B is coupled to, and thus may deliver a different voltage/tone signal to the multiswitch. The voltage/tone signal typically comprises a 13 Volts DC (VDC) or 18 VDC signal, with or without a 22 kHz tone superimposed on the DC signal. 13 VDC without the 22 kHz tone would select one port, 13 VDC with the 22 kHz tone would select another port of the multiswitch, etc. There can also be a modulated tone, typically a 22 kHz tone, where the modulation schema can select one of any number of inputs based on the modulation scheme. For simplicity and cost savings, this control system has been used with the constraint of 4 cables coming for a single feedhorn assembly 124, which therefore only requires the 4 possible state combinations of tone/no-tone and hi/low voltage, although other embodiments are possible within the scope of the present invention.

To reduce the cost of the ODU 108, outputs of the LNBs 128 present in the ODU 108 can be combined, or "stacked," depending on the ODU 108 design. The stacking of the LNB 128 outputs occurs after the LNB has received and downconverted the input signal. This allows for multiple polarizations, one from each satellite 102-106, to pass through each LNB 128. So one LNB 128 can, for example, in one embodiment, receive the Left Hand Circular Polarization (LHCP) signals from SatC 102 and SatB 104, while another LNB receives the Right Hand Circular Polarization (RHCP) signals from SatB 104, which allows for fewer wires or cables between the feedhorn assembly 124 and the multiswitch.

The Ka-band of downlink signals 120 are typically further divided into two bands, an upper band of frequencies called the "A" band and a lower band of frequencies called the "B" band. Satellites are deployed within system 100 to broadcast these frequencies, and the various LNBs 128 in the feedhorn assembly 124 can then deliver the signals from the Ku-band, the A band Ka-band, and the B band Ka-band signals for a given polarization to the multiswitch.

By stacking the LNB 128 inputs as described above, each LNB 128 typically delivers 48 transponders of information to the multiswitch, but some LNBs 128 can deliver more or less in blocks of various size. The multiswitch allows each output of the multiswitch to receive every LNB 128 signal (which is an input to the multiswitch) without filtering or modifying that information, which allows for each IRD 112 to receive more data. However, as mentioned above, current IRDs 112 cannot use the information in some of the proposed frequencies used for downlink signals 120, thus rendering useless the information transmitted in those downlink signals 120.

As system 100 includes new satellites, ODU 108 must be pointed in a more accurate fashion to properly receive downlink signals 120 for processing by IRD 112. However, current alignment techniques and ODU designs are not accurate enough for such alignments.

It can be seen, then, that there is a need in the art for an alignment schema and mechanical alignment mechanisms that can align an ODU for expanded systems 100.

SUMMARY OF THE INVENTION

To minimize the limitations in the prior art, and to minimize other limitations that will become apparent upon reading and understanding the present specification, the present invention discloses embodiments of an alignment tool for aligning an antenna to a satellite configuration and methods for aligning an antenna to a satellite configuration.

For example, in accordance with one embodiment, an alignment tool for aligning an antenna to a satellite configuration in accordance with the present invention comprises a meter for measuring a received power from the antenna, a motor for adjusting at least one fine adjustment mechanism of the antenna, and a processor, coupled to the motor and to the meter, for commanding the motor based on the received power from the antenna, wherein the processor commands the motor to maximize a received power from the antenna.

Such an alignment tool may further optionally comprise: at least one fine adjustment mechanism adjusting the antenna in an azimuth direction and/or an elevation direction, a power supply, coupled to the meter and the motor, for providing power to the meter and the motor, a coupler for coupling the motor to the at least one fine adjustment mechanism of the antenna, an indicator, coupled to the processor, wherein the indicator shows when an alignment of the antenna is completed, and the meter sensing a raw radio frequency signal power from the satellite configuration.

A method for aligning an antenna to a satellite configuration in accordance with one or more embodiments of the present invention comprises coupling a meter to an output of the antenna, measuring a signal strength from the output of the antenna, coarsely aligning the antenna in azimuth and elevation, coupling a motor to at least one fine alignment mechanism of the antenna, and adjusting the fine alignment mechanism with the motor, wherein the motor is moved based on the signal strength received from the output of the antenna such that signal strength is maximized using the fine alignment mechanism.

Such a method may further optionally comprise: at least one fine adjustment mechanism adjusting the antenna in an azimuth direction and/or an elevation direction, a power supply providing power to the meter and the motor, coupling the motor to the at least one fine alignment mechanism is performed using a flexible coupler, comprising indicating when an alignment of the antenna is completed, and measuring a signal strength from the output of the antenna further comprising sensing a raw radio frequency signal power from the satellite configuration.

Other features and advantages are inherent in the system and method claimed and disclosed or will become apparent to those skilled in the art from the following detailed description and its accompanying drawings.

BRIEF DESCRIPTION OF THE DRAWINGS

Referring now to the drawings in which like reference numbers represent corresponding parts throughout.

DETAILED DESCRIPTION

In the following description, reference is made to the accompanying drawings which form a part hereof, and which show, by way of illustration, several embodiments of the present invention. It is understood that other embodiments may be utilized and structural changes may be made without departing from the scope of the present invention.

Overview

Currently, there are several orbital slots, each comprising one or more satellites, delivering direct-broadcast television programming signals to the various ODUs 108. However, ground systems that currently receive these signals sometimes cannot accommodate additional satellite signals without adding more cables, and cannot process the additional signals that will be used to transmit the growing complement of high-definition television (HDTV) signals. The HDTV signals can be broadcast from the existing satellite constellation, or broadcast from the additional satellite(s) that will be placed in geosynchronous orbit. The orbital locations of the Ku-BSS satellites are fixed by regulation as being separated by nine degrees, so, for example, there is a satellite at 101 degrees West Longitude (WL), SatA 102; another satellite at 110 degrees WL, SatC 106; and another satellite at 119 degrees WL, SatB 104. Additional satellites may be at other orbital slots, e.g., 72.5 degrees, 95, degrees, 99 degrees, and 103 degrees, and other orbital slots, without departing from the scope of the present invention. The satellites are typically referred to by their orbital location, e.g., SatA 102, the satellite at 101 WL, is typically referred to as "101." Additional orbital slots, with one or more satellites per slot, are presently contemplated at 99 and 103 (99.2 degrees West Longitude and 102.8 degrees West Longitude, respectively).

Pivot Mechanism and Degree Readings

Figure 1:
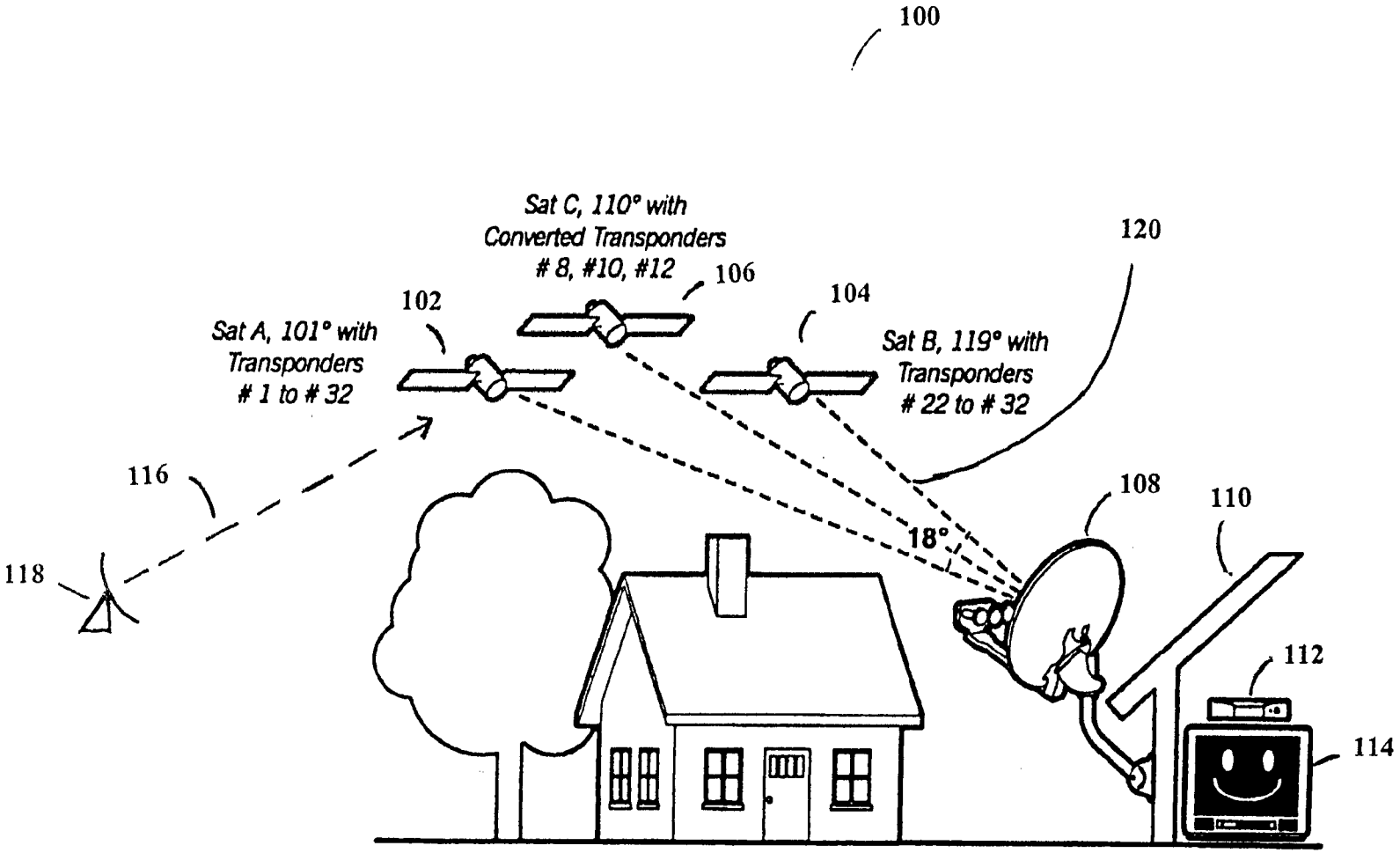
FIG. 1 illustrates a typical satellite television installation of the related art.
Figure 2:
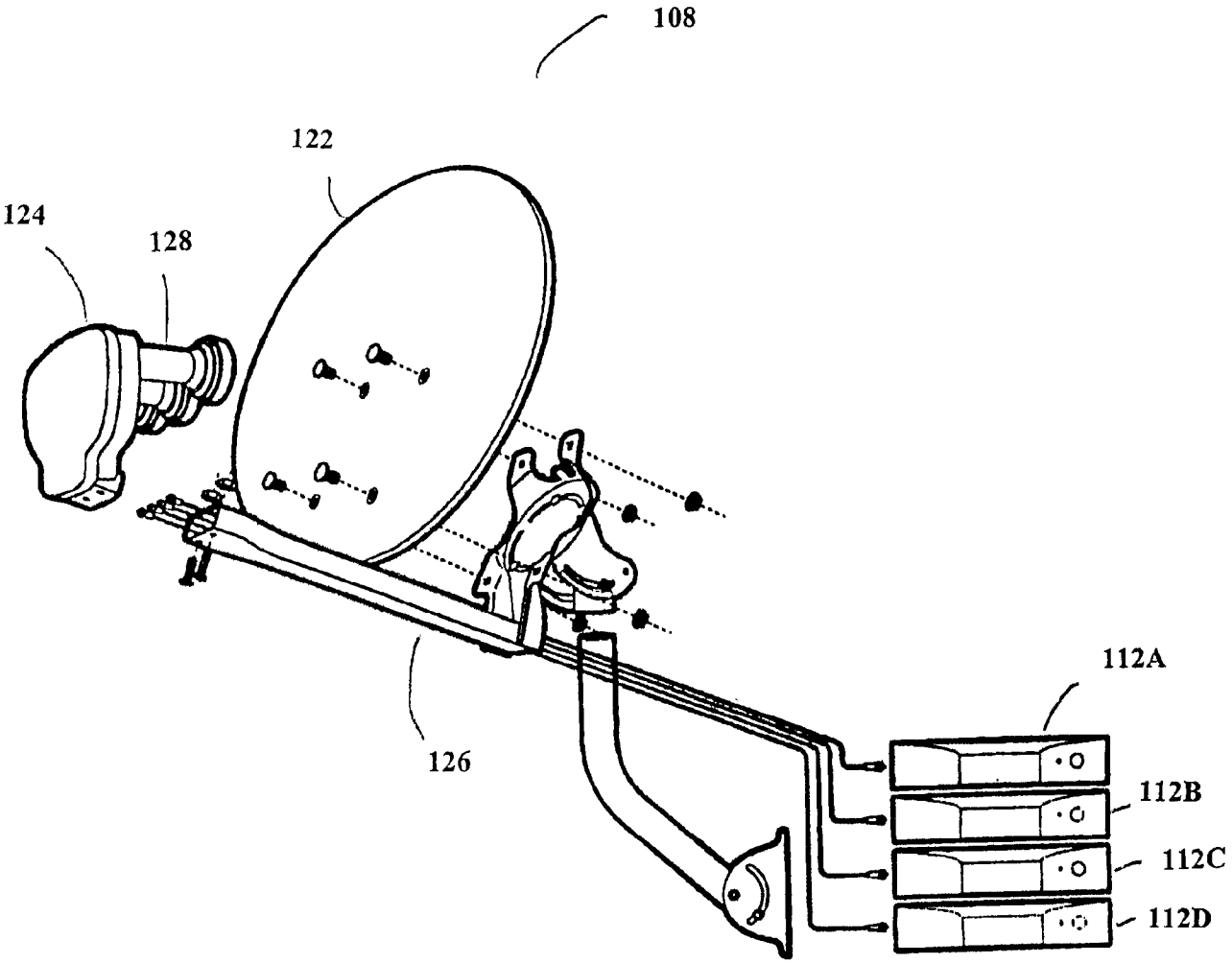
FIG. 2 illustrates a typical ODU of the related art.
Figure 3:
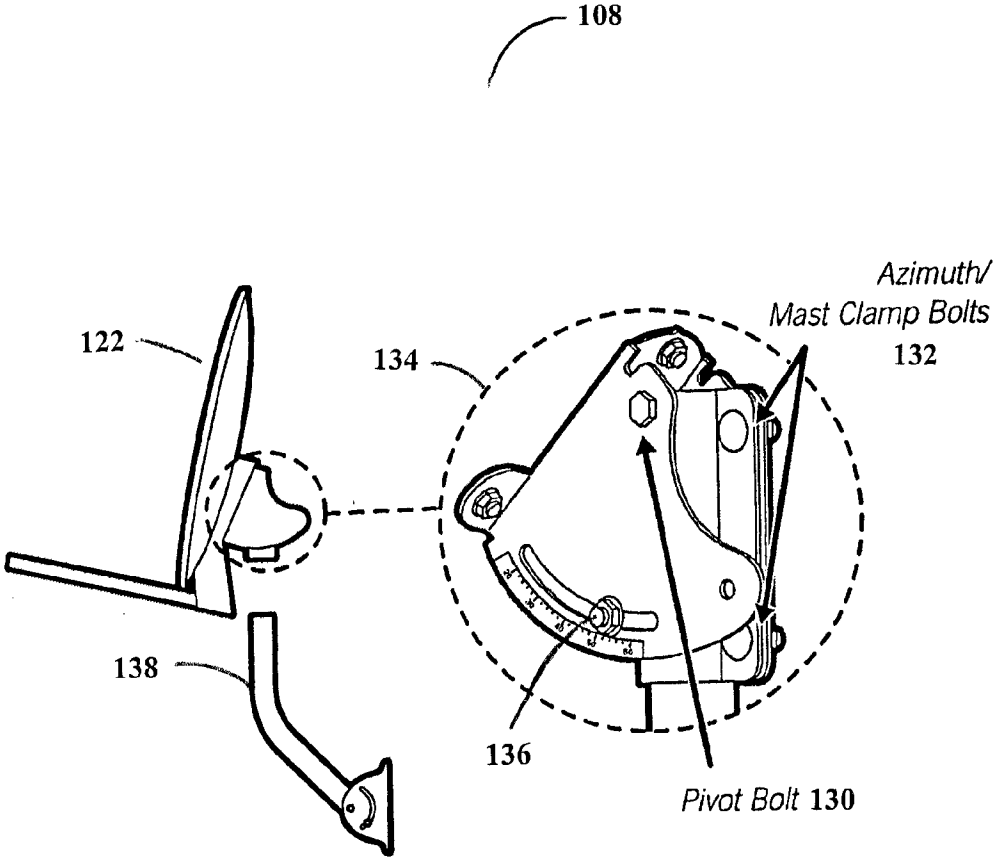
FIG. 3 illustrates an azimuth and elevation alignment mechanism of the related art.

FIG. 3 illustrates an azimuth and elevation alignment mechanism of the related art.

ODU 108 is shown, with reflector 122, and pivot bolt 130 and azimuth/mast clamp bolts 132 which are part of a coarse alignment mechanism 134. Lock nut 136 and mast 138 are also shown. Mechanism 134 attaches to mast 138, and is secured using bolts 132.

To adjust the elevation of ODU 108, lock nut 136 is loosened, and a specific elevation angle is set for a specific geoposition of the ODU 108. The lock nuts are then tightened to hold the ODU 108 in the desired elevation angle.

To adjust the azimuth, ODU 108 is rotated about mast 138, and a signal meter is used to find a power peak for a given downlink signal 120. Bolts 132 are set at a specific pre-load, however, the bolts are typically loosened by installers so that mechanism 134 can fit easily on mast 138, which allows assembly 134 to rotate rather freely on mast 138. When bolts 132 and 136 are tightened, the settings for the azimuth and elevation of ODU 108 are typically lost, or moved through some slight degree, which puts errors into the alignment of ODU 108.

Fine Adjustment of Azimuth and Elevation

The present invention provides one or more embodiments to easily, quickly and with little installer intervention, align DIRECTV's multi-feed Ka/Ku outdoor units (ODUs) in the azimuth and elevation directions. The installer would connect the equipment and then allow the invention to align the dish automatically.

The currently used techniques require the installer to manually move the dish back and forth in the azimuth and elevation directions to correctly find the peak of downlinked RF beam and thereby align the dish toward the satellites in geosynchronous orbit. So, for example, in one embodiment, the installer rotates the dish back and forth around mast 138 and tightens bolt 136 to some specified angle, and wiggles dish 122 around until the signal is "good enough." The problem with such an approach is that the installer may not perform this process correctly, or in the extreme case, may not perform this 'dithering' process at all. The present invention, however, automates the dithering process and reduces the actions required by the installer. Further, such installations are more accurate and repeatable since they are automated.

As such, the present invention, in a preferred embodiment, uses a coarse alignment procedure, and then uses an alignment tool that can automate the fine adjustment of the ODU 108.

Alignment Procedure

Generally, the ODU 108 has Ku-band beamwidths that are about 3 degrees wide, whereas the Ka-band beamwidths are substantially smaller. Aligning the ODU 108 typically involves the following processes.

(1) Install the ODU mount 138, making sure the mount 138 is vertical.

(2) Set the elevation and azimuth of dish 122, and, using a meter that measures the downlink RF power or the downlink signal's modulation error ratio, perform a course alignment for the signals coming from satellites at the 101 orbital slot.

(3) Perform the fine alignment of dish 122 in the vertical (elevation) direction by dithering. Lock down the dish in this plane using bolt 136.

(4) Perform the fine alignment in the azimuthal direction by dithering. Lock down the dish in this plane using bolts 132.

(5) Change the tilt (rotation) of the feed as suitable for the latitude and longitude of the ODU 108. Lock down the dish 122.

Presently, installers either omit steps 3 and 4, or do not perform steps 3 and 4 accurately enough to align the Ka-band downlink signals 120, such that services delivered by the Ku-band satellites will perform as expected, but the 'availability' of services delivered by the Ka-band satellites could be severely degraded. This is because the coarse alignment using only the Ku-band feeds does not point the dish with sufficient accuracy and the signals levels for the Ka-band downlinks may be substantially below the levels needed for full service availability of system 100.

Further, the lock down of dish 122 in the final position often slightly misaligned the ODU 108, which would lead to frustration on the part of the installer and inaccuracies and reduced received downlink 120 signal strength for system 100.

FIGS. 4-7 illustrate the fine alignment mechanisms used in accordance with one or more embodiments of the present invention.

Figure 4:
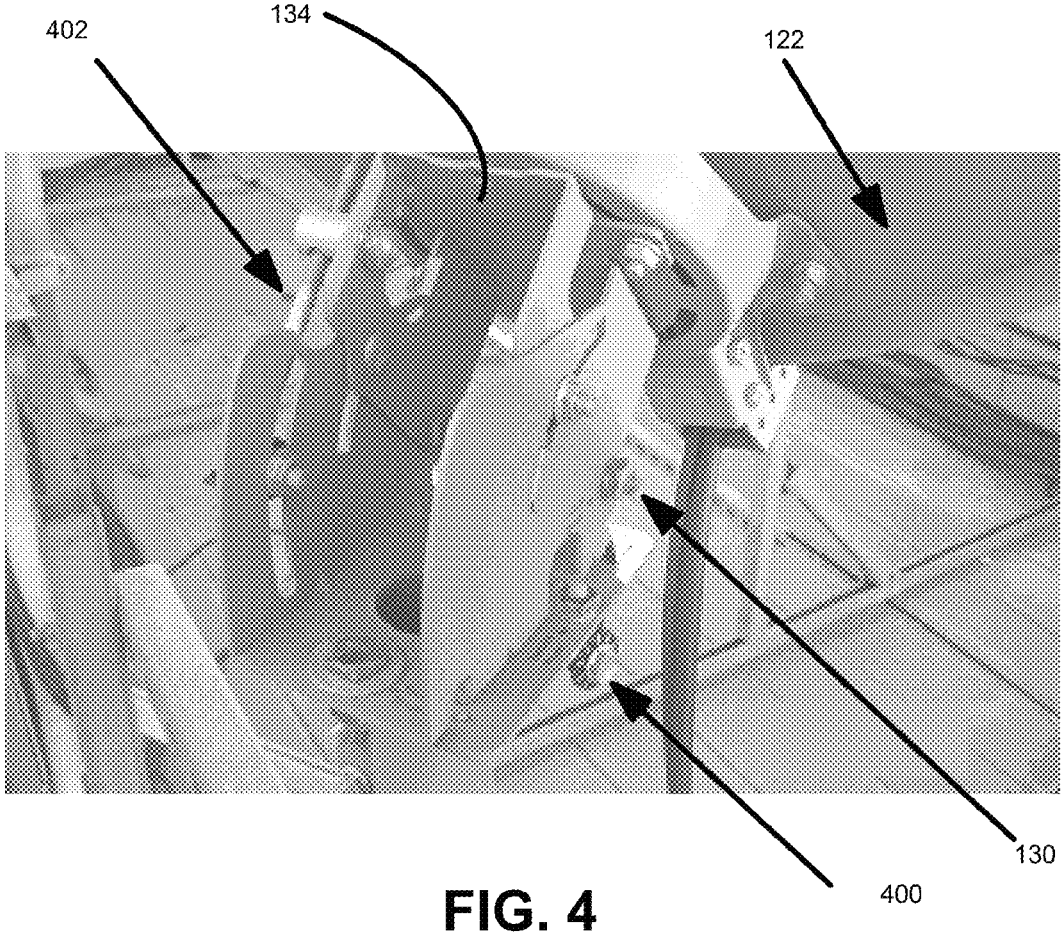
FIGS. 4-7 illustrate the fine alignment mechanisms used in accordance with one or more embodiments of the present invention.
Figure 5:
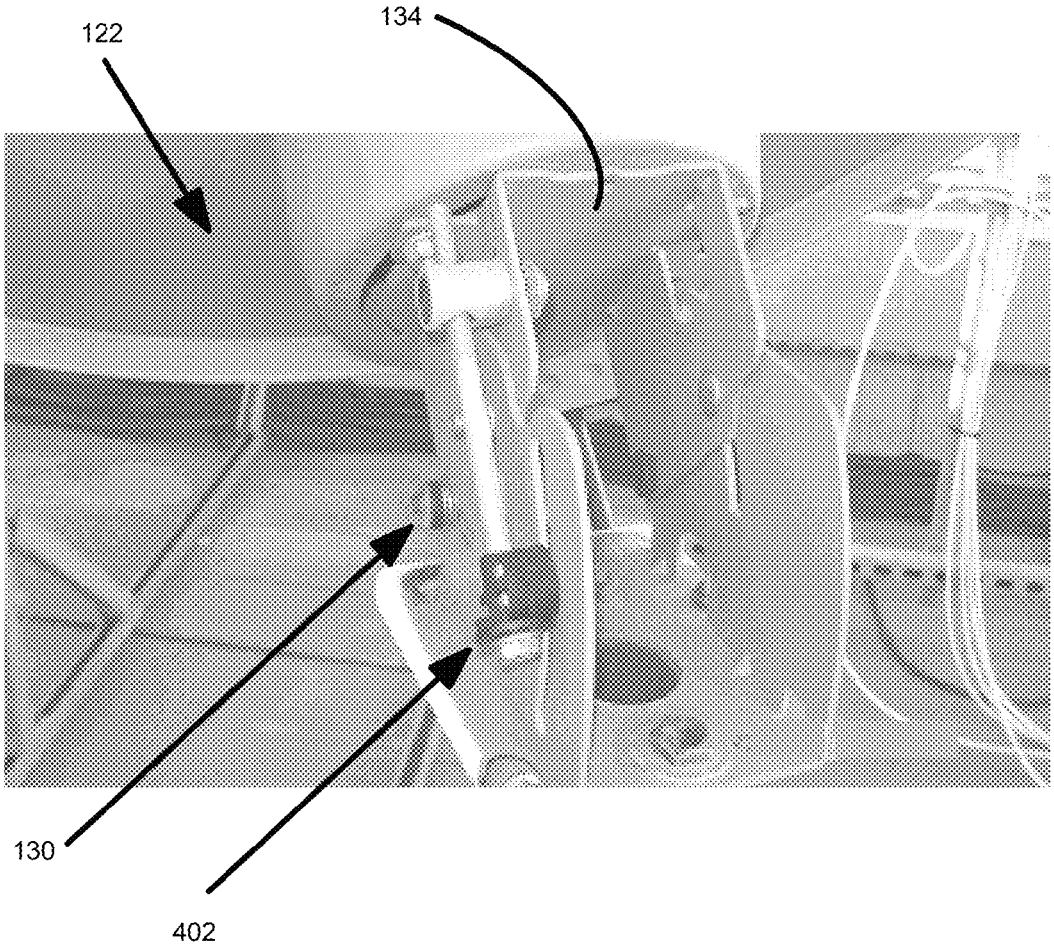
Figure 6:
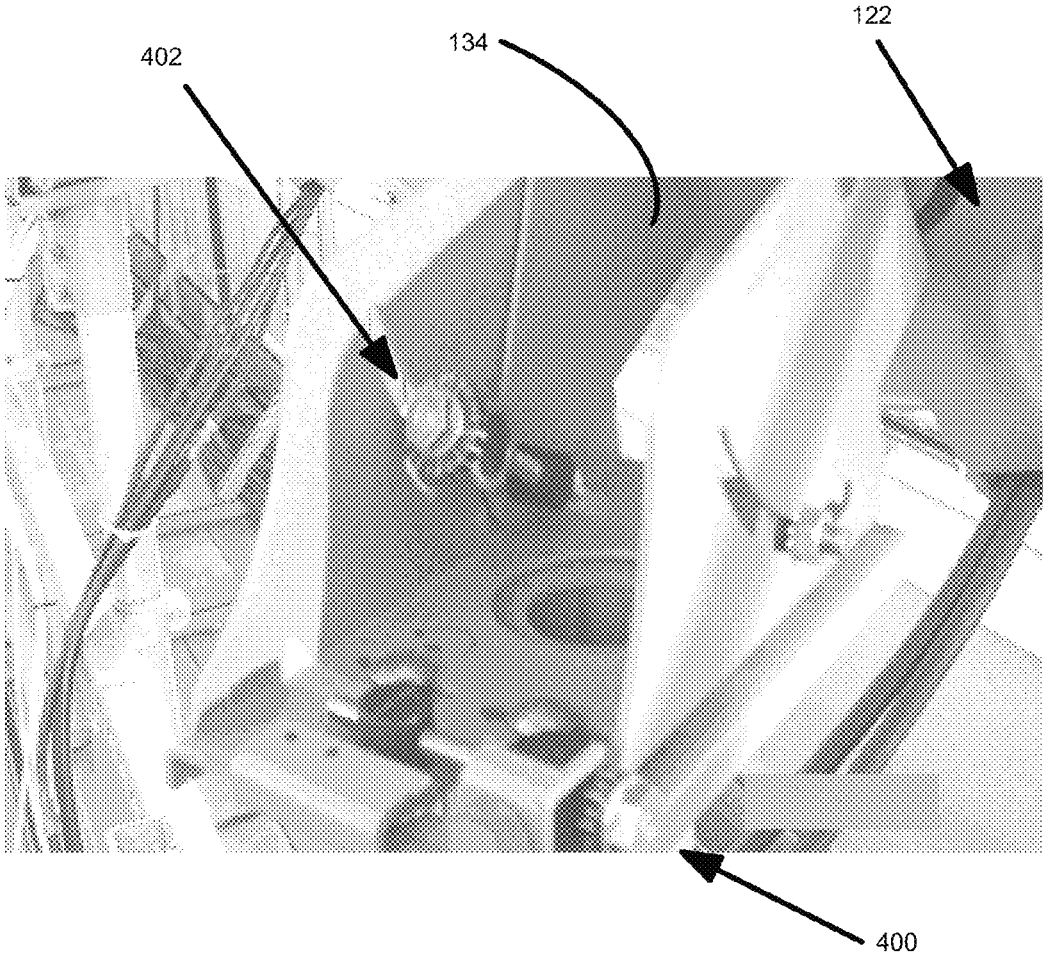
Figure 7:
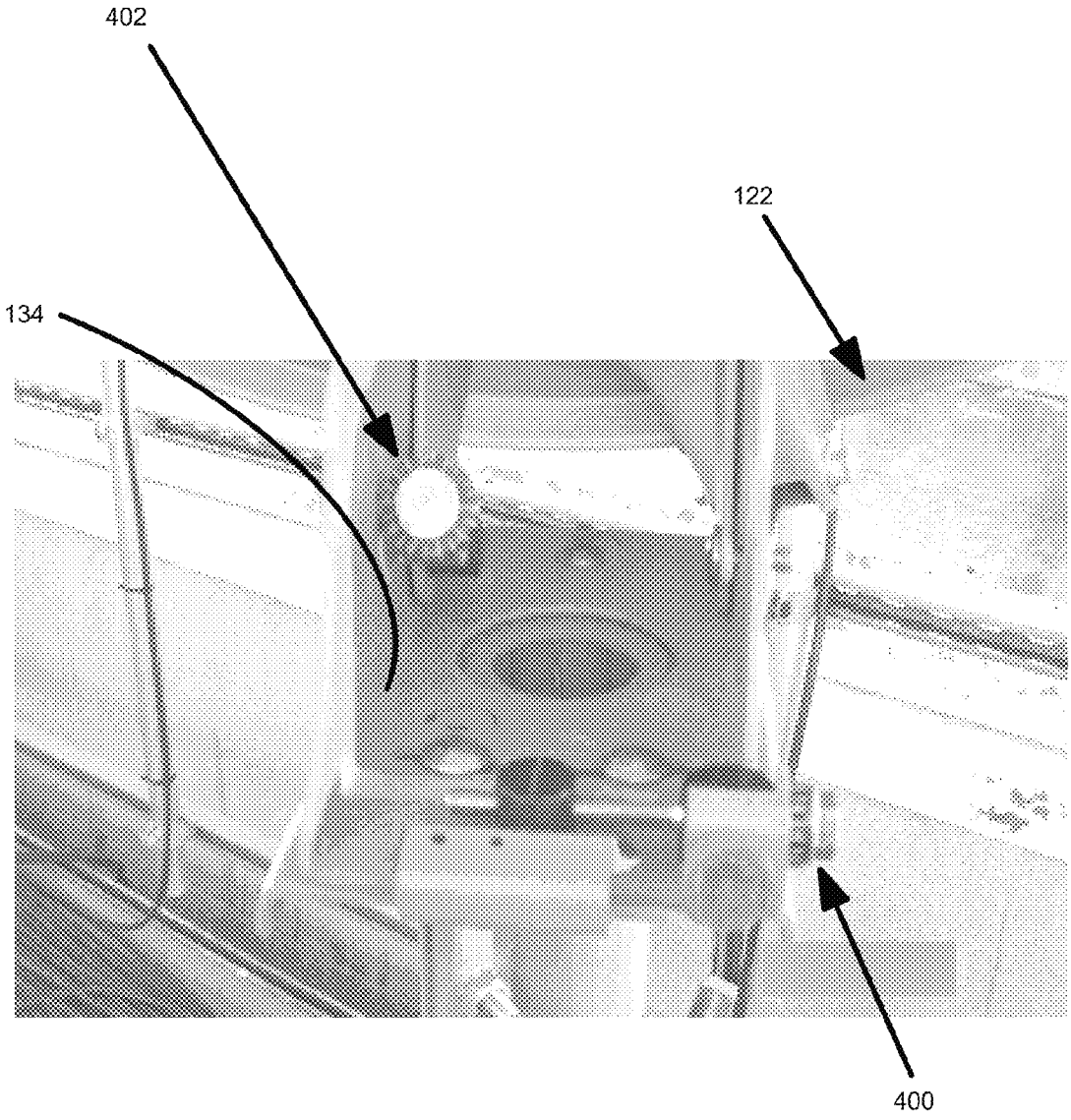

As shown in FIGS. 4 and 5, attached to coarse alignment mechanism 134 is a fine adjustment mechanism that uses azimuth fine adjustment control 400 and elevation fine adjustment control 402 to provide small, exact control over the azimuth and elevation alignment of dish 122. Each control 400 and 402 typically comprises a threaded rod, gear, and hex nut which moves the ODU 108/dish 122 in precise increments such that a more precise alignment of ODU 108 is achieved. Because of the design of the fine adjustment controls 400 and 402, and the fine threading of the mechanism, the controls 400 and 402 are essentially self-locking, and do not move once they are set into a given position.

Other embodiments of coarse alignment mechanism 134 is shown in FIGS. 6 and 7, again, with a fine adjustment mechanism that includes azimuth fine adjustment control 400 and elevation fine adjustment control 402 providing small, exact control over the azimuth and elevation alignment of dish 122.

Auto Alignment Tool

Figure 8:
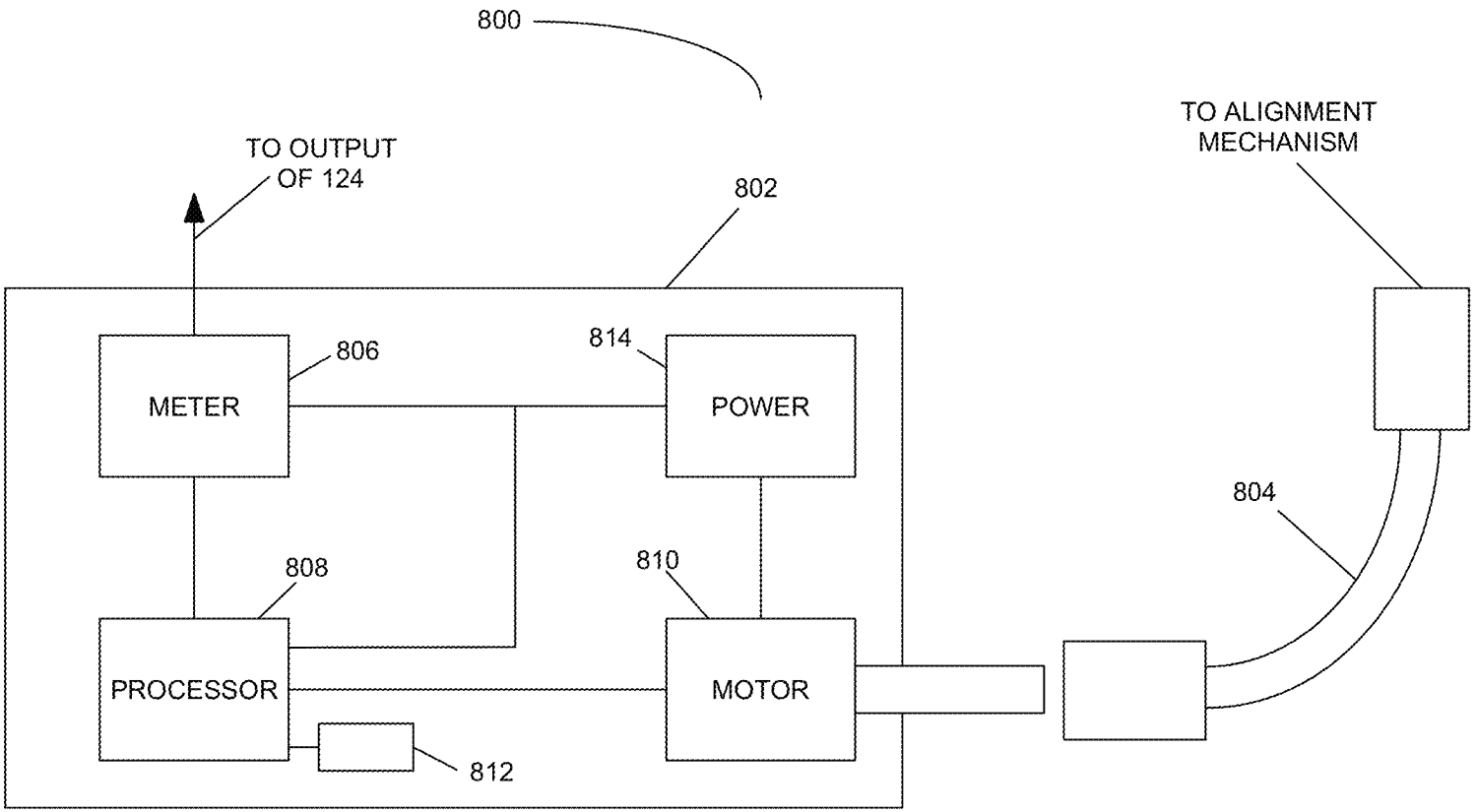
FIG. 8 illustrates a block diagram of an embodiment of an auto-alignment tool in accordance with one or more embodiments of the present invention.

FIG. 8 illustrates a block diagram of an embodiment of an auto-alignment tool in accordance with one or more embodiments of the present invention.

Tool 800 can comprise a unit 802 and coupling 804. Unit 802 typically comprises a meter 806, a processor 808, and a motor 810.

The meter 806 senses the downlink 120 power for one or more selected transponders from satellites 102-106. Typically, meter 806 either senses the raw RF power from one or more transponders (an analog type of meter) or demodulates the signal and report the signals modulation error ratio. Either approach can be used within the scope of the present invention, although the analog meter 806 approach may be preferred. Processor 808 can be used to perform the alignment process described below.

The motor 810 is typically a stepper motor, but can also be a DC motor if desired, which couples to flexible coupling 804 that attaches to the fine tuning element, i.e., azimuth fine adjustment control 400 and elevation fine adjustment control 402 of the ODU 108.

Initially, meter 806 is coupled to the outputs of feedhorn assembly 124 to measure the received power reflected from reflector 122. Coarse adjustments are made to roughly align reflector 122 to receive downlink signals 120.

When an acceptable signal strength is received by meter 806, e.g., a coarse pointing of the reflector 122 results in a certain minimum signal strength which indicates that the reflector 122 is generally pointed toward the satellites 102-106 of interest, flexible coupling 804 is attached to azimuth fine adjustment control 400 typically via a hex nut that is part of azimuth fine adjustment control 400, and processor 808 is typically commanded to move motor 810 while monitoring meter 806. As motor 810 rotates, azimuth fine adjustment control 400 is rotated, which moves the reflector dish 122 in small increments. For each increment, or for each number of increments, meter 806 takes a measurement to determine the signal strength received. After a predetermined amount of travel for azimuth fine adjustment control 400, which is typically measured by the number of rotations made by motor 810, processor 808 reverses the direction of travel of motor 810, and continues to make measurements using meter 806.

After the azimuth fine adjustment control 400 has traveled through the desired amount of distance, which moves the reflecting dish 122 through a range of angles, processor 808 has recorded the highest received signal strength and at what position the reflector dish 122 received this highest recorded signal strength, as well as when the signal strength has dropped by some amount, e.g., 3 dB down from the maximum signal strength. Processor 808 can then determine how many motor 810 turns are needed to return reflector dish 122 to the position of highest signal strength, and sends commands to motor 810 to return dish 122 to such a position. Processor 808 can continue to monitor the signal strength of the downlink 120 via meter 806 to confirm that the motor 810 has returned reflector dish 122 to the proper position. So, for example, and not by way of limitation, the highest signal strength and −3 dB points are recorded, along with other points, by processor 808. Typically, the highest signal strength point is in the middle of the two −3 dB points, and processor 808 can determine when the −3 dB points are reached and then move the reflector dish in between these points, or halfway from the first −3 dB point, or can monitor the movement of the reflector dish 122 all the way until the highest signal strength point is reached.

The fine alignment procedure described for the azimuth direction above can then be repeated in the elevation direction using elevation fine control 402 to exactly point reflector 122 toward the maximum signal strength direction. Further, the directions can be reversed, e.g., fine elevation alignment can be performed first, and then fine azimuth alignment, and the present invention also contemplates returning to the first fine alignment direction performed to verify that the first fine alignment direction is still correct.

So, a coarse alignment is made in both azimuth and elevation, in either order, and then a coarse tilt adjustment is made to reflector 122. After this coarse adjustment of reflector 122, a fine alignment adjustment is made using azimuth fine control 400 and elevation fine control 402, in either order, using the meter of the present invention.

Once the alignment is completed, processor 808 then signals to the installer that the installation is completed, either via an indicator 812, which can be an indicator light or some other visual or audible indicator to the installer that the azimuth alignment is complete. So, for example, in one embodiment of the present invention, the indicator 812 can show a red or yellow condition while the alignment is taking place, and turn green when the processor 808 has completed the alignment procedure. Since azimuth fine adjustment mechanism 400 can be essentially a self-locking mechanism, the lock down procedure used in the related art may not be required in the present invention, and thus no misalignment of ODU 108 occurs after determination of the maximum signal strength position. However, other types of fine adjustment mechanisms 400 and 402 can be used with a lock down procedure as used in the related art, so long as the lock down procedure does not affect the fine alignment performed in accordance with the present invention. The tool 802 can be powered by an external or internal power supply 814 if desired, or if a Single Wire Multiswitch (SWM) ODU 108 is being aligned, by the external power inserter that is needed for the SWM LNB used for the SWM ODU 108.

Process Chart

Figure 9:
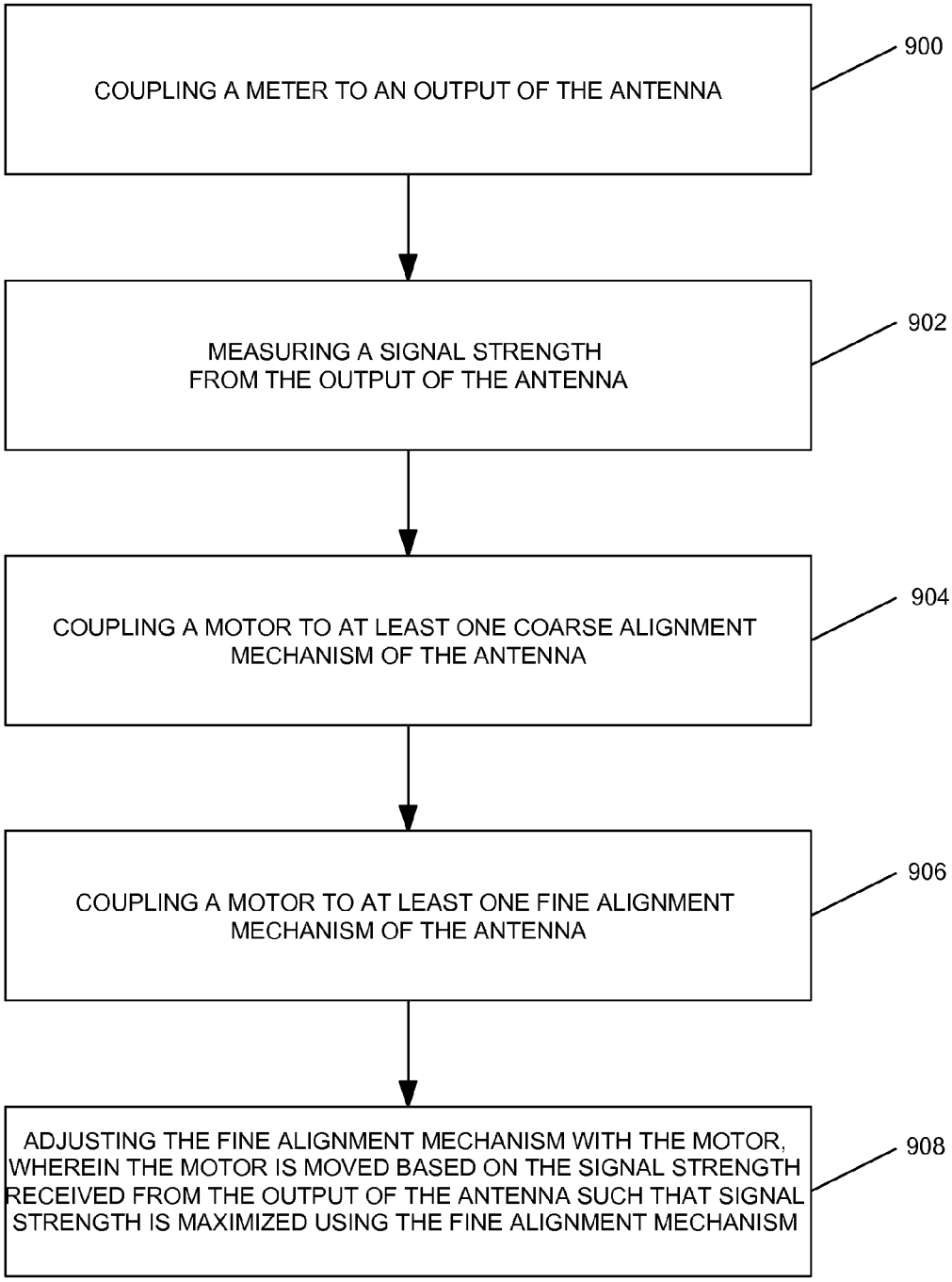
FIG. 9 illustrates a process chart in accordance with one or more embodiments of the present invention.

FIG. 9 illustrates a process chart in accordance with one or more embodiments of the present invention.

Box 900 illustrates coupling a meter to an output of the antenna.

Box 902 illustrates measuring a signal strength from the output of the antenna.

Box 904 illustrates coarsely aligning the antenna in azimuth and elevation.

Box 906 illustrates coupling a motor to at least one fine alignment mechanism of the antenna.

Box 908 illustrates adjusting the fine alignment mechanism with the motor, wherein the motor is moved based on the signal strength received from the output of the antenna such that signal strength is maximized using the fine alignment mechanism.

CONCLUSION

In summary, the present invention comprises an alignment tool for aligning an antenna to a satellite configuration and a method for aligning an antenna to a satellite configuration.

An alignment tool for aligning an antenna to a satellite configuration in accordance with the present invention comprises a meter for measuring a received satellite downlink signal power from the antenna, a motor for adjusting at least one fine adjustment mechanism of the antenna, and a processor, coupled to the motor and to the meter, for commanding the motor based on the received power from the antenna, wherein the processor commands the motor to maximize a received power from the antenna.

Such an alignment tool further optionally comprises the at least one fine adjustment mechanism adjusting the antenna in an azimuth direction and/or an elevation direction, a power supply, coupled to the meter and the motor, for providing power to the meter and the motor, a coupler for coupling the motor to the at least one fine adjustment mechanism of the antenna, an indicator, coupled to the processor, wherein the indicator shows when an alignment of the antenna is completed, and the meter sensing a raw radio frequency signal power from the satellite configuration.

A method for aligning an antenna to a satellite configuration in accordance with the present invention comprises coupling a meter to an output of the antenna, measuring a signal strength from the output of the antenna, coarsely aligning the antenna in azimuth and elevation, coupling a motor to at least one fine alignment mechanism of the antenna, and adjusting the fine alignment mechanism with the motor, wherein the motor is moved based on the signal strength received from the output of the antenna such that signal strength is maximized using the fine alignment mechanism.

Such a method further optionally comprises the at least one fine adjustment mechanism adjusting the antenna in an azimuth direction and/or an elevation direction, a power supply providing power to the meter and the motor, coupling the motor to the at least one fine alignment mechanism is performed using a flexible coupler, comprising indicating when an alignment of the antenna is completed, and measuring a signal strength from the output of the antenna further comprising sensing a raw radio frequency signal power from the satellite configuration.

It is intended that the scope of the invention be limited not by this detailed description, but rather by the claims appended hereto and the equivalents thereof. The above specification, examples and data provide a complete description of the manufacture and use of the composition of the invention. Since many embodiments of the invention can be made without departing from the spirit and scope of the invention, the invention resides in the claims hereinafter appended and the equivalents thereof.

What is claimed is:

1. An alignment tool for aligning an antenna to a satellite configuration, comprising:

a meter for measuring a satellite downlink signal power from the antenna;

a motor for adjusting at least one fine adjustment mechanism of the antenna; and a processor, coupled to the motor and to the meter, for commanding the motor based on the received power from the antenna, wherein the motor is coupled to the at least one fine adjustment mechanism after a coarse alignment mechanism adjusts the antenna and the processor commands the motor to maximize a received power from the antenna.

2. The alignment tool of claim 1, wherein the at least one fine adjustment mechanism adjusts the antenna in an azimuth direction.

3. The alignment tool of claim 1, wherein the at least one fine adjustment mechanism adjusts the antenna in an elevation direction.

4. The alignment tool of claim 1, further comprising a power supply, coupled to the meter and the motor, for providing power to the meter and the motor.

5. The alignment tool of claim 1, further comprising a coupler for coupling the motor to the at least one fine adjustment mechanism of the antenna.

6. The alignment tool of claim 1, further comprising an indicator, coupled to the processor, wherein the indicator shows when an alignment of the antenna is completed.

7. The alignment tool of claim 1, wherein the meter senses a raw radio frequency signal power from the satellite configuration.

8. A method for aligning an antenna to a satellite configuration, comprising:

coupling a meter to an output of the antenna;

measuring a signal strength from the output of the antenna;

coarsely aligning the antenna in azimuth and elevation with a coarse alignment mechanism;

coupling a motor to at least one fine alignment mechanism of the antenna after the coarse alignment; and adjusting the fine alignment mechanism with the motor, wherein the motor is moved based on the signal strength received from the output of the antenna such that signal strength is maximized using the fine alignment mechanism.

9. The method of claim 8, wherein the at least one fine adjustment mechanism adjusts the antenna in an azimuth direction.

10. The method of claim 8, wherein the at least one fine adjustment mechanism adjusts the antenna in an elevation direction.

11. The method of claim 8, wherein a power supply provides power to the meter and the motor.

12. The method of claim 8, wherein coupling the motor to the at least one fine alignment mechanism is performed using a flexible coupler.

13. The method of claim 8, further comprising indicating when an alignment of the antenna is completed.

14. The method of claim 8, wherein measuring a signal strength from the output of the antenna further comprises sensing a raw radio frequency signal power from the satellite configuration.

* * * * *